United States Patent [19]

Ready

[11] 4,294,332

[45] Oct. 13, 1981

[54] SCAFFOLD WITH GEAR DRIVE

[76] Inventor: Delbert L. Ready, P.O. Box 19462, Houston, Tex. 77024

[21] Appl. No.: 29,601

[22] Filed: Apr. 13, 1979

[51] Int. Cl.[3] ..... E04G 1/20

[52] U.S. Cl. ..... 182/141; 182/132

[58] Field of Search ..... 182/146, 145, 132, 141, 182/148; 187/9 R, 9 E, 2

[56] References Cited

U.S. PATENT DOCUMENTS

| | | | |
|---|---|---|---|
| 2,803,503 | 8/1957 | Borgman | 182/132 |
| 2,904,126 | 9/1959 | Meng | 182/148 |
| 3,438,460 | 4/1969 | Solari | 182/146 |
| 3,610,368 | 10/1971 | Johnson | 182/146 |
| 3,612,219 | 10/1971 | Fortner | 182/146 |
| 3,848,970 | 12/1974 | Hutchens | 182/141 |

FOREIGN PATENT DOCUMENTS

| | | | |
|---|---|---|---|
| 623432 | 10/1962 | Belgium | 182/148 |

*Primary Examiner*—Reinaldo P. Machado
*Attorney, Agent, or Firm*—Michael P. Breston

[57] ABSTRACT

The scaffold unit comprises a pair of towers, each having a pair of rails held together by crossties. Each rail has a gear rack on the front face thereof. The towers are held in fixed lengthwise parallel alignment by cross braces removably attached to the sides of the rails facing each other. A self-elevating, platform-supporting carriage projects outwardly from each tower. The carriage has a frame which supports a pair of upright shoes, each defining a U-shaped channel for slidably receiving a rail therein. The shoes fit over and guide the carriage on the rails when the carriage is in motion. A shaft is rotatably mounted on the frame and carries a pair of gears which mesh with the racks through slots in the shoes. A controllable motor is adapted to rotate the shafts independently of, or in synchronism with, each other. Since the crossties and the lengthwise braces are connected between the faces of the rails which are free of the shoes, the carriages can be moved up or down to any desired level without having to first remove any of the crossties or cross braces.

16 Claims, 8 Drawing Figures

FIG. 2.
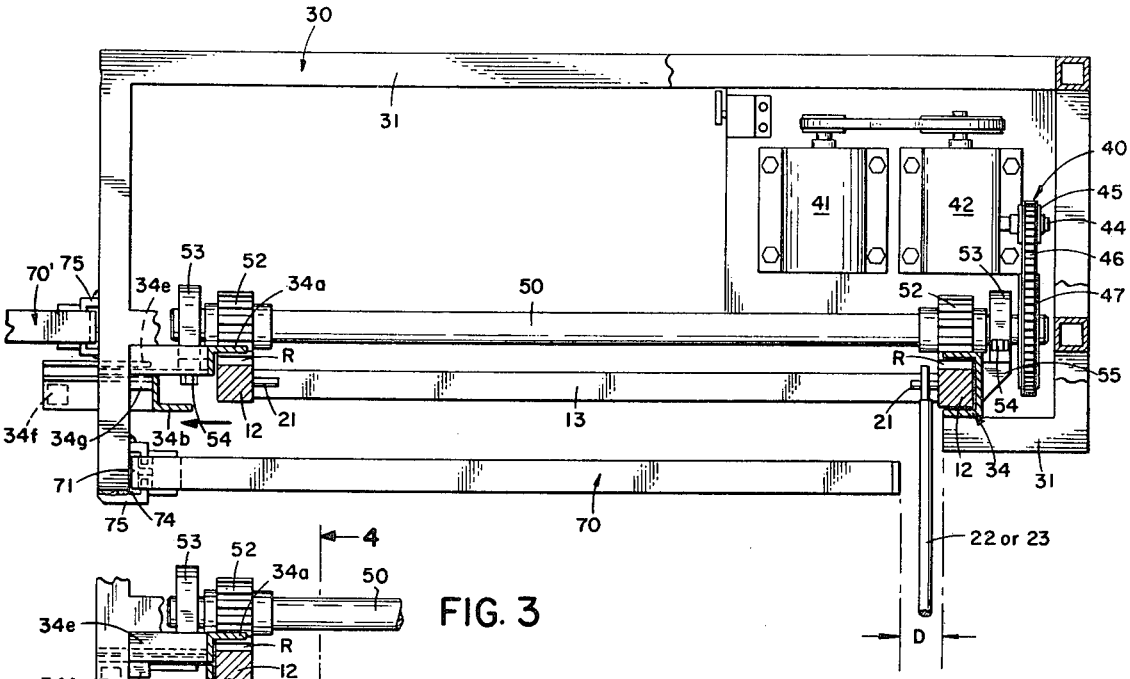
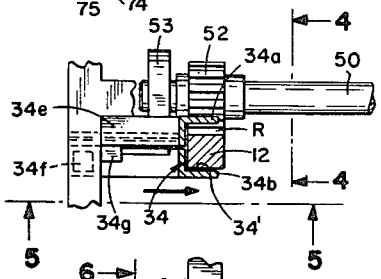
FIG. 3
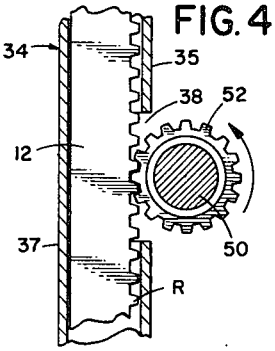
FIG. 4
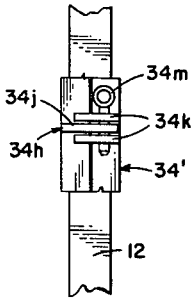
FIG. 6.
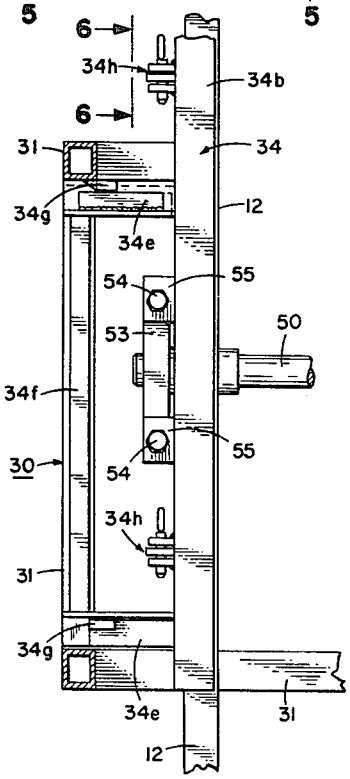
FIG. 5
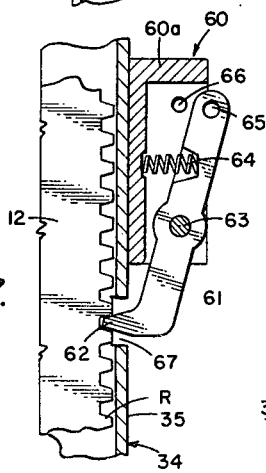
FIG. 7.
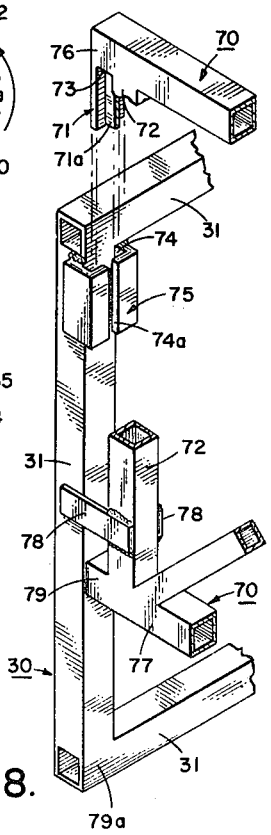
FIG. 8.

SCAFFOLD WITH GEAR DRIVE

BACKGROUND OF THE INVENTION (a) Field of the Invention

The invention relates generally to scaffolding systems and particularly to scaffolds with gear drives.

(b) Description of the Prior Art

Many scaffolds are known of the gear drive type and of the non-gear drive type. Scaffolding systems are made up of basic units from which high towers can be erected so that workers can do work on multi-story buildings. Typically, a pair of towers spaced-apart lengthwise are interconnected by cross braces to make a free-standing scaffolding unit. The units are aligned to make a continuous scaffolding for any desired length of wall. The towers can be vertically extended with tower inserts, typically 3 meters high, by adding them to a tower base unit. Any tower insert can be plugged into any base or any other insert. First, a pair of tower bases are erected upright on the ground level and interconnected by cross braces. Then, a number of tower inserts are added to reach full wall height.

A carriage, adapted to ride up on each tower, supports at least two plank platforms: the masons' platform which is typically adjustable from 25 cm to about 50 cm, and the material and laborers' platform, which is typically about 2 meters wide, and positioned above the masons' platform.

In a very common non-gear type scaffolding, each carriage has a winch that is operated by a laborer to raise the two-level platform as a wall is being built. The cable on the winch reaches up and is attached to a cable hook. A cable hook is built into the top of each tower insert. The carriage can be locked to the tower at any level to permit attaching the winch cable to a higher hook.

In a gear type scaffolding which I have previously developed, the carriage could move up but before it could move down, side panel braces had to be first removed. Also, after the scaffolding was fully erected to the height of the wall to be built, the movements of the carriage were limited to about 1 meter between such side panel braces. Accordingly, my prior scaffolding has not met with great commercial success.

The problems with known scaffolds will be better understood from the following.

The primary object of scaffolding is to provide safe working conditions for the laborers and masons. A secondary object is to achieve labor savings. Masons wish to go on the scaffolding when the wall is only about 1 meter above grade and also desired to be kept continuously at their most efficient working level until the wall is completed. Then they desired to move down as rapidly as possible on the scaffolding itself and not depend on a crane or lift.

A two-level platform is frequently raised to keep the masons working at their most efficient level. The material is stacked on the upper platform for easy reach by the masons who work from the lower platform.

The goal of good scaffolding design is that there be little interruption of production which means that the masons should not be required to move from one location to another, since each such move results in a loss of valuable time in reorganization before full production can be resumed. Thus, full production can be assured when there is no appreciable work interruption, while the platforms, material and workers are being moved to a higher level as the wall goes up.

For the same goal, the scaffolding should be erectable to full wall height before the masons go to work, and it should be capable of being easily extended while the wall is being built, using as a means for such extension the basic scaffolding units themselves without the aid of auxiliary machines.

A further consideration is the time it takes to set up, plank, and dismantle the scaffolding. While the wall is being erected and some material is used up, it may be desired that the workers and masons be allowed to move down to a lower level or to the grade level without having to first remove with auxiliary machines or a secondary scaffolding the cross braces and side braces under the planks.

In spite of such desirata, in known scaffolding including my previous scaffold, the removal of such braces from high scaffolding typically requires fork-lift trucks or cranes at considerable expense of money and of workers' time. Also, the erecting and dismantling of known scaffolds or the moving of their plank platforms to a lower level may require the setting up of an adjacent scaffolding, all of which consumes considerable time which is not productive as far as the wall construction is concerned.

A further objective is to be able to fabricate the scaffolding from common steel shapes using simple tools, such as welding tools which are widely available even in underdeveloped countries.

In sum, a careful study will indicate that the most serious problem facing known present scaffolding is the lack of flexibility in allowing the carriages on the towers to ride down with their platforms without having to first remove longitudinal braces, side braces, or panel braces which are used to tie pairs of towers or upright posts together where safety codes require continuous bracing.

It should be understood that when braces are removed under the platform, they may have to be replaced above the platform for maintaining the pair of towers in each scaffolding unit in fixed parallel relation. Such replacement is also very time consuming.

After experimenting for several years, I have now developed a gear-type scaffolding which is a great improvement over my previous scaffolding and eliminates therefrom the drawbacks above described.

SUMMARY OF THE INVENTION

A free-standing scaffolding unit constructed in accordance with the invention comprises a pair of ladder-type towers. Each tower has a pair of rails of rectangular cross section. Sideties between the side walls of the rails hold them in fixed parallel alignment. Each rail has gear teeth on its front face. The individual towers are held in fixed lengthwise parallel alignment by cross braces removably attached to the sides of the rails on one side of the unit.

A self-elevating, platform-supporting carriage is clampable to each tower. It has a frame projecting outwardly from its tower. Each carriage frame supports a pair of upright shoes, each adapted to fit over three sides of a rail, thereby rigidly guiding the moving carriage on the rails of the tower.

More specifically, each shoe defines a U-shaped channel which slidably receives its mating rail. The shoe has a slot in the outward front side thereof. The open sides of the pair of shoes on the same carriage face each other, thereby clamping the carriage to the rails. The carriages are free to move in a vertical direction but not tilt in a horizontal direction.

A shaft is rotatably mounted on the carriage frame and carries a pair of pinion gears which are meshable through the slots in the shoes with the gear teeth on the rails. Bi-directional power means controllably rotate the shaft on each frame in either direction. The pair of shafts on each scaffolding unit can be rotated in synchronism or independently of each other.

The U-shaped shoes can accommodate the moving up of the platform-supporting carriage without interference from the cross braces joining pairs of towers, and from the sideties joining the pair of rails within each tower. If the cross braces are used only on one side of the scaffolding unit, then the carriages and their entire platforms can be moved down without interference from the cross braces. If the cross braces are used on both sides of the towers, there is a need for first shifting the center platform in between the towers to a side platform projecting outside of the towers, and then the carriages can move down without interference from the cross braces on both sides of the pair of towers.

BRIEF DESCRIPTION OF THE DRAWINGS

FIG. 2 is a top view, partly in section, of the left carriage shown in FIG. 1;

FIG. 3 is a top view, partly in section, of the split U-shaped shoe when in its clamping position;

FIGS. 4 and 5 are views on lines 4—4, 5—5, respectively, of FIG. 3;

FIG. 6 is a front view of the lock for the split shoe;

FIG. 7 is a side view of the safety latch on each rail; and

FIG. 8 is a fragmentary view showing a center platform supporting panel brace member mounted on or removed from the carriage frame.

DETAILED DESCRIPTION OF A PREFERRED EMBODIMENT

Figure 1:
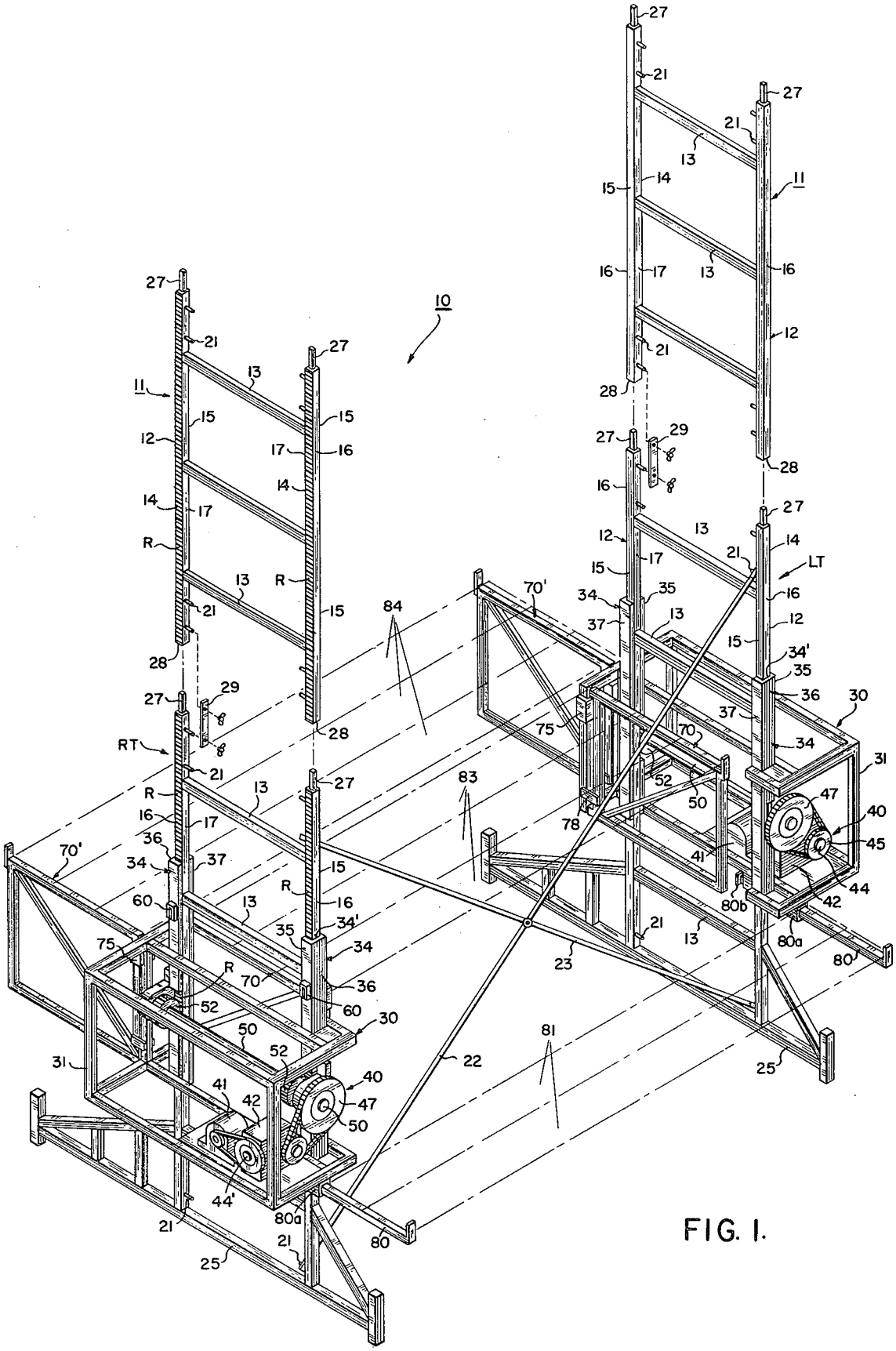
FIG. 1 is a perspective view of the basic scaffolding unit in accordance with the invention, showing the platforms in dotted lines.

In accordance with the invention, the basic self-standing scaffolding unit, generally designated as 10 (FIG. 1), includes a pair of non-free standing longitudinally-spaced parallel towers: a left tower LT and a right tower RT. Each tower has a base 25 from which extends a ladder-type structure which consists of two side rails 12 joined together at vertical intervals by sideties 13. Each rail is of rectangular cross section having front and back walls 14, 15 and outer and inner side walls 16, 17. The sideties 13 rigidly interconnect the two opposite inner side walls 17. Each front wall 14 of each rail 12 carries gear teeth which form a linear gear rack R. Pins or hooks 21 (FIG. 2) horizontally extend from the top and bottom ends of the inner side wall 17. A pair of longitudinal cross braces 22, 23 are removably latched to the pins 21 of the pair of towers to form the basic, free-standing scaffolding unit 10.

Extension towers 11 can be coupled to the towers of the base unit 10 by pin and socket connections 27, 28, for erecting a scaffolding of any desired height. The tower inserts 11 are secured by plates 29.

Each tower accommodates a self-elevating, platform-supporting carriage, generally designated as 30. The right tower RT has a right carriage and the left tower LT has a left carriage. The carriages, as will be obvious from the drawings, are not interchangeable. In practice they are painted with different colors to avoid confusion.

Each carriage 30 has an open, box-like frame 31 consisting of vertical and horizontal angular structural members suitably welded together. Frame 31 must extend outwardly of each tower. The carriage frame supports a pair of upright shoes 34 adapted to fit over the rails 12 and to guide the moving carriage on the rails. Each shoe 34 has front, side, and back walls 35, 36, 37, respectively, forming therebetween a U-shaped channel 34', preferably of substantially rectangular cross section. The open sides of opposite shoes 34 face each other. Each shoe slidably receives its mating rail 12 and has a front slot or window 38 (FIG. 4) facing the gear rack R on the rail.

Each carriage 30 supports a bi-directional drive means, generally designated as 40, having an electric motor 41 whose shaft is coupled to the input shaft 44' of of a conventional transmission gear box 42 having an output shaft 44. A sprocket 45 on shaft 44 transmits through a chain to a sprocket 47 the torque produced by motor 41.

Sprocket 47 is fixed onto a horizontal shaft 50 which is rotatably mounted in suitable end bearing blocks 53. The driven shaft 50 carries two laterally-spaced pinion gears 52 which mesh with the gear racks R through the windows 38 in the shoes 34.

Transmission 42 includes, internally, in a conventional manner, suitable breaking means (not shown) to prevent carriage 30 from falling down when motor 41 is de-energized. The two motors 41 on the pair of carriages 30 on the basic scaffolding unit 10 are powered to be driven in synchronism or independently of each other.

In accordance with a preferred embodiment of the invention, each carriage 30 can be removably clamped onto its mating tower 10 at any desired level. This is accomplished by having one upright shoe 34 split vertically into two L-shaped shoe parts; a stationary front part **34*a* and a slidable rear part 34*b* (FIGS. 2, 3, 6). The rear part 34*b* can be moved by a handle 34*f* up to a stop 34*g*. Part 34*b* is guided by guides 34*e***.

The bearing blocks 53 (FIG. 5) are bolted by bolts 54 to brackets 55 which are welded to the backwalls of shoes 34. Bracket 55 on the split shoe 34 is welded to the fixed part **34*a*. The back wall of part 34*b* is notched (not shown) so that it will pass bolts 54 as it is moved on the guides 34*e***.

When the two L-shaped parts are aligned, they form the desired U-shaped channel 34' (FIG. 6). When the rear part **34*b* is fully moved outwardly relative to the stationary part 34*a* (FIG. 2), the carriage 30 can be clamped onto the rails 12 with the pinion gears meshing with their racks R. After such meshing is achieved, the rear part 34*b* is moved into its normal locking or clamping position (FIG. 3), and the two L-shaped parts are fastened together by a lock 34*h* which consists of a plate 34*j* welded to part 34*a* and of parallel plates 34*k* welded to part 34*b*. A locking pin 34*m* is inserted when the holes (not shown) in plates 34*k* are aligned to form a rigid shoe 34**.

To unclamp the carriage from its tower, the rear part **34*b* is first moved out (FIG. 2); the carriage 30** is rotated slightly clockwise and is moved slightly to the right; and then the carriage is removable from its tower by pulling it back.

As can be best seen from the drawings, the frames of the carriages 30 move without physical interference past the projecting pins 21, the sideties 13, and the longitudinal cross braces 22, 23.

An automatic latch mechanism 60 is fixed to the wall 35 of each shoe 34 (FIG. 7). Mechanism 60 consists of a housing 60*a* to which a latch 61 is pivotably mounted on a pivot 63 and having a tooth-shaped tongue 62 which engages the groove between a pair of teeth on the rack R below housing 60*a*. The latch 61 is normally biased outwardly above pivot 63 by a coil spring 64. A slotted opening 67 in wall 35 of shoe 34 allows tongue 62 to engage rack R. The latch will allow the carriage to move up on the rails but will lock the carriage against downward movement. To remove the locking effect of the latch 61, it is pushed inwardly against the force of the coil spring 64 and a pin is inserted in holes 65, 66 when they become aligned.

The carriage is provided with a center panel brace 70. The top beam member of panel 70 extends past the upright beam member 72 as at 76, and has a downwardly-extending splined member 71. A spline receiving bracket 75, welded to a vertical leg of frame 31, has a vertical slot 74*a*. The lower portion of beam 72 has plates 78 attached to each side thereof. The lower beam 77 of the panel also extends past the vertical beam 72 as at 79. When lowered into position, the spline 71 extends into the bracket opening 74 with the perpendicular member 71*a* engaging slot 74*a*. The underside 73 of the upper beam rests on the top of the bracket 75. The plates 78 embrace the vertical leg of the frame 31. The projection 79 abuts against the vertical member as at 79*a*. Panel brace 70 is disengaged from hinge 71 by pulling up vertically thereon.

Carriage 30 is also provided with a side panel brace 70' identical in construction and operation to brace panel 70. Panel braces 70 and 70' are interchangeable and easily removable. The center panel braces 70 of a pair of carriages 30 on a scaffolding unit 10 support a planked platform 83 which normally carries the materials required by the masons. The side panel braces 70' carry the laborers' planked platform 84.

A pair of slidable extension arms 80 project from the opposite side of the carriage 30 relative to the panel brace 70'. Arm 80 slides in a rectangular bracket 80*a*, welded to frame 31, and has a stop 80*b*. The side arms 80 carry the masons' planked platform 81. All the platforms are shown in dotted lines. Platforms 83, 84 are at an upper level and platform 81 is at a lower level.

The two-level platform structure is frequently raised to keep the masons working at their most efficient level. The material being stacked on the center platform 83 is within easy reach by the masons.

In accordance with a very important advantage of the invention, after reaching full wall height, the platforms can ride down to the grade level, or to any desired level in between, without the necessity of removing cross braces 22, 23 below the moving platforms and replacing such braces above the moving platform. Thus, with the novel construction of scaffolding 10, the riding down problem of conventional carriages has been solved in a very efficient and economical manner by the present invention.

In FIG. 1 the cross braces 22, 23 are shown on one side of the scaffolding unit only. For very high towers it may be desired, or the rules may require, that a second set of cross braces 22, 23 be also provided on the opposite side (not shown) of the scaffolding unit 10 so that the towers are completely braced from both sides.

In that case, in order to allow the carriages to move down without having to remove the second set of cross braces, all that is necessary is to shift the planks 83 over the planks 84, remove the two center panel braces 70, and then the carriages will be free to move down as in the case where only one set of cross braces 22, 23 is utilized.

As can be best seen from FIGS. 1, 2, the center panel braces 70 are at a distance D from the rail 12 so that panels 70 do not interfere with the first set of cross braces 22, 23 while the carriages 30 are moving up or down. It will also be seen that by removing the panel braces 70 from the carriages, the carriages will move down or up even when a second and opposite set of cross braces 22, 23 are attached to pins 21.

These features also allow the entire scaffolding for a particular wall to be erected to full wall height before the masons go to work. With the rising costs in material and labor, the above significant advantages of the scaffolding of this invention will result in significant savings in the construction costs of the wall.

As a further advantage, while the wall is being erected, it may be desirable that the workers and masons move down to a lower level. This can be easily done with the scaffolding of this invention without having to first remove cross braces under the platforms. The removal of such cross braces from conventional scaffolding is a very time-consuming job and frequently requires fork-lift trucks or cranes. On construction jobs where such heavy duty machines are not available, there was, in accordance with prior practice, a need to use a second adjacent set of scaffolding to service the main scaffolding.

Thus, an important object of this invention has been achieved in that great flexibility is allowed for the carriages on the towers to ride up or down, with or without their platforms, without having to remove side braces, end panel braces, or longitudinal braces.

Advantage is taken of this flexibility to use the basic scaffolding unit 10 itself for erecting the next tower insert 11 and the following tower inserts 11 until the full wall height is reached. The dismantlement of the scaffold can be just as easily achieved without the assistance of heavy equipment.

Using the gear drive, and the self-elevated carriages, the movement of the platforms, up or down, is as easy as flipping a switch which controls the rotations of the shafts 50.

The base scaffolding units 10 and the tower inserts 11 are constructed of rectangular steel giving the scaffolding good load-carrying capacity, strength, rigidity and at the same time allowing the carriages to have channel steel shoes 34 which ride up or down on the rails 12.

Using the elongated shoes 34, the weight of the carriages and their platforms is distributed over a substantial length portion of rails 12, thereby virtually eliminating excessive binding and strain on the towers.

Another appreciable advantage of the invention resides in the fact that the construction of the scaffolding is relatively simple and requires angle and channel steel which is widely available and the fabrication of the scaffolding requires simple tools, primarily welding tools.

What is claimed is:

1. A scaffolding unit comprising:

at least two towers each having a front and a back and each tower having a pair of rails, each rail having a linear gear rack facing the front of each tower;

bracing means for rigidly interconnecting said two rails;

cross-bracing members coupled to the rails of opposite towers for maintaining said towers in back-to-back and spaced relationship;

a platform-supporting carriage having a frame outwardly extending from the front of each tower, a pair of laterally-spaced upright shoes on said frame, each shoe having a U-shaped cross section adapted to movably embrace a rail, each shoe defining an opening facing the front of each tower, said shoes having open sides which face each other; and bi-directional drive means on said frame for moving said carriage up and down on said towers, said drive means having pinion gears meshable with the racks of said rails through said openings in said shoes.

2. A scaffolding unit comprising:

at least two towers each having a pair of rails, each rail having a linear gear rack;

bracing means for rigidly interconnecting said two rails;

cross-bracing members coupled to the rails for maintaining said towers in rigid and spaced relationship;

a platform-supporting carriage having a frame outwardly extending from each tower, a pair of laterally-spaced upright shoes on said frame, each shoe having a U-shaped cross section adapted to movably embrace a rail, each shoe defining an opening, said shoes having open sides which face each other, and one shoe having two parts, one part being movable relative to the other part; and bi-directional drive means on said frame for moving said carriage, said drive means having pinion gears meshable with the racks of said rails through said openings in said shoes.

3. A scaffolding unit comprising:

at least two towers, each tower having a pair of side rails of substantially rectangular cross section defined by front and back walls and outer and inner side walls, each rail having on its front wall a linear gear rack;

first bracing members for rigidly interconnecting said two side rails in laterally-spaced, parallel relationship;

second bracing members coupled to the inner side walls of said rails for maintaining said towers in spaced relationship;

a platform-supporting carriage having a frame outwardly extending from each tower, a pair of laterally-spaced upright shoes on said frame, each shoe having a U-shaped cross section defined by front, back, and outer side walls adapted to receive therein and move over a rail, each shoe having a front wall defining an opening, and the shoes having open sides facing each other;

bi-directional drive means on said frame, said drive means having pinion gears meshable with said racks of said rails through said openings in said shoes, said drive means moving said carriage up or down on said rails depending on the angular rotation of said pinions; and said shoes sliding past said first and second bracing members during said up and down movements of said carriage.

4. A scaffolding unit comprising:

at least two towers, each tower having a pair of side rails of rectangular cross section defined by front and back walls and outer and inner side walls, each rail having on its front wall a linear gear rack;

first bracing members for rigidly interconnecting said two side rails in laterally-spaced, parallel relationship;

second bracing members coupled to the inner side walls of said rails for maintaining said towers in spaced relationship;

a platform-supporting carriage having a frame outwardly extending from each tower, a pair of laterally-spaced upright shoes on said frame, each shoe having a U-shaped cross section defined by front, back, and outer side walls adapted to receive therein and move over a rail, each shoe having a front wall defining an opening, the shoes having open sides facing each other; one shoe having two L-shaped parts, one part being movable relative to the other part, the movable part serving to complete the clamping action of said one shoe when it surrounds the rail on three sides, and said movable part unclamping the rail when removed from the other part, thereby permitting the mounting and dismounting of the carriage on and from the tower at any desired level;

bi-directional drive means on said frame, said drive means having pinion gears meshable with said racks of said rails through said openings in said shoes, said drive means moving said carriage up or down on said rails depending on the angular rotation of said pinions; and said shoes sliding past said first and second bracing members during said up and down movements of said carriage.

5. The scaffolding unit of claim 4, wherein said front wall, back wall and outer wall of each channel are respectively opposite to the front, back, and outer side walls of said rails.

6. The scaffolding unit of claim 4 and means for locking said L-shaped parts together to form said U-shaped shoe, said movable part being movable inwardly for clamping the rail, and said movable part also being movable outwardly for freeing the carriage frame from the rails.

7. A scaffolding unit, comprising:

a pair of longitudinally-spaced, parallel towers, each tower having a base from which extends a ladder-type structure which consists of two side rails joined together at vertical intervals by sideties, each rail having a substantially rectangular cross section formed by front and back walls and outer and inner side walls, said sideties rigidly interconnecting the two opposite inner side walls of said rails, each front wall of each rail carrying gear teeth which form a linear gear rack, pins horizontally extending from the inner side wall of at least one rail in each tower, a pair of longitudinal cross braces removably latched to said pins of said pair of towers to form said scaffolding unit;

each tower having a self-elevating, platform-supporting carriage, each carriage having a frame extending outwardly of each tower, each frame supporting a pair of upright shoes adapted to fit over said rails and to guide the moving carriage on said rails, each shoe having front, side, and back walls forming therebetween a channel, said shoes having open sides facing each other, each shoe slidably receiving its mating rail and having a front slot facing said gear rack on the rail;

each carriage being removably clamped onto its mating tower at any desired level, and one upright shoe being split vertically into two L-shaped shoe parts, a stationary front part and a slidable rear part, whereby when the rear part is fully moved outwardly relative to the stationary part, the carriage can be clamped onto the rails with the pinion gears meshing with their racks, and after the meshing is achieved, the rear part is moved into its normal clamping position whereat the two L-shaped shoe parts are aligned and fastened together to form said U-shaped channel; and a bi-directional drive means mounted on each carriage, said drive means having an electric motor whose shaft is coupled to the input shaft of a transmission gear box, a driven shaft rotatably mounted on said carriage frame, said gear box having an output shaft that transmits the torque produced by said motor to said driven shaft, two laterally-spaced pinion gears on said driven shaft, and said pinion gears meshing with said gear racks through said slots in said shoes.

8. The scaffolding unit of claim 7, and a center panel brace removably attached to each carriage frame and extending between the towers for supporting a center platform.

9. The scaffolding unit of claim 8, and a side panel brace removably attachable to each carriage frame and extending outside of the towers for supporting a side platform.

10. The scaffolding unit of claim 9, wherein the center and side panels are interchangeable.

11. A scaffolding unit comprising:

at least two towers each having a front and a back;

bracing members for maintaining the towers in back-to-back and spaced relationship;

a platform-supporting carriage having a frame outwardly extending from the front of each tower, a pair of laterally-spaced upright shoes on said frame, each shoe having a U-shaped cross section adapted to receive therein and move over a rail, each shoe having an opening facing the front of each tower, and said shoes having open sides facing each other; and bi-directional drive means on said frame for riding said carriage up and down on said towers.

12. A scaffolding unit comprising:

at least two towers;

bracing members for maintaining the towers in rigid spaced realtionship;

a platform-supporting carriage having a frame outwardly extending from each tower, a pair of laterally-spaced upright shoes on said frame, each shoe having a cross section adapted to receive therein and move over a rail, said shoes having open sides facing each other, one shoe having two parts, one shoe part being movable relative to the other shoe part; and bi-directional drive means on said frame for moving said carriage.

13. The scaffolding unit of claim 12, wherein said U-shaped cross section is substantially rectangular.

14. A scaffolding unit comprising:

at least two towers each having a pair of rails, each rail having a linear gear rack;

bracing members for rigidly interconnecting said two rails;

cross-bracing members for maintaining said towers in spaced, upright relationship;

a platform-supporting carriage having a frame outwardly extending from each tower, a pair of laterally-spaced upright shoes on said frame, each shoe having side walls adapted to embrace a rail, one side wall in each shoe defining an opening and one shoe having two parts, one shoe part being movable relative to the other shoe part;

bi-directional drive means on said frame for moving said carriage; and said drive means having pinion gears meshable with said racks through said openings in said shoes.

15. A scaffolding unit comprising:

at least two towers, each tower having a pair of side rails of substantially rectangular cross section defined by front and back walls and outer and inner side walls, each rail having on its front wall a linear gear rack;

first bracing members for rigidly interconnecting said two side rails in laterally-spaced, parallel relationship;

second bracing members coupled to the inner side walls of said rails for maintaining said towers in spaced relationship;

a platform-supporting carriage having a frame outwardly extending from each tower, a pair of laterally-spaced upright shoes on said frame, each shoe having walls adapted to embrace and move said carriage over a rail, each shoe having a front wall defining an opening, at least one shoe consisting of two parts, one shoe part being movable relative to the other shoe part for permitting the mounting and dismounting of said carriage on and from said tower;

bi-directional drive means on said frame, said drive means having pinion gears meshable with said racks through said openings in said front walls of said shoes for moving said carriage up and down on said rails; and said shoes being adapted without interruption to slide past said first and second bracing members during said up and down movements of said carriage.

16. A scaffolding unit, comprising:

a pair of longitudinally-spaced, parallel towers, each tower having a base from which extends a ladder-type structure which consists of two side rails joined together at vertical intervals by sideties, each rail having a substantially rectangular cross section formed by front and back walls and outer and inner side walls, said sideties rigidly interconnecting the two opposite inner side walls of said rails, each front wall of each rail carrying gear teeth which form a linear gear rack, pins horizontally extending from the inner side wall of at least one rail in each tower, a pair of longitudinal cross braces removably latched to said pins of said pair of towers to form said scaffolding unit;

each tower having a self-elevating, platform-supporting carriage, each carriage having a frame extending outwardly of each tower, each frame supporting a pair of upright shoes adapted to fit over said rails and to guide the moving carriage on said rails, each shoe having front, side, and back walls forming therebetween a channel for slidably receiving its mating rail, and each shoe having a slot facing said gear rack on the rail, and at least one upright shoe being split vertically into a stationary front shoe part and a slidable rear shoe part;

a bi-directional drive means mounted on each carriage, said drive means having an electric motor;

a driven shaft rotatably mounted on said carriage frame;

transmission means coupling said electric motor to said driven shaft;

a pair of laterally-spaced pinion gears on said driven shaft, and said pinion gears meshing with said gear racks through said slots in said shoes for riding said carriage up and down on said tower free from interference from said horizontally-extending pins.

* * * * *